US009857772B2

(12) United States Patent
Jufer et al.

(10) Patent No.: US 9,857,772 B2
(45) Date of Patent: Jan. 2, 2018

(54) WATCH INTENDED TO BE MOUNTED ON A REMOVABLE SUPPORT

(71) Applicant: ETA SA Manufacture Horlogere Suisse, Grenchen (CH)

(72) Inventors: Martin Jufer, Melchnau (CH); Roger Mueller, Schoenbuehl (CH); David Benjamin Kraehenbuehl, Bettlach (CH)

(73) Assignee: ETA SA Manufacture Horlogere Suisse, Grenchen (CH)

( * ) Notice: Subject to any disclaimer, the term of this patent is extended or adjusted under 35 U.S.C. 154(b) by 0 days.

(21) Appl. No.: 15/091,047

(22) Filed: Apr. 5, 2016

(65) Prior Publication Data

US 2016/0313702 A1 Oct. 27, 2016

(30) Foreign Application Priority Data

Apr. 27, 2015 (EP) ..... 15165231

(51) Int. Cl.
*G04B 37/12* (2006.01)
*G04B 37/14* (2006.01)
*A44C 5/14* (2006.01)

(52) U.S. Cl.
CPC ..... *G04B 37/1486* (2013.01); *A44C 5/147* (2013.01); *G04B 37/12* (2013.01); *G04B 37/1413* (2013.01); *G04B 37/1433* (2013.01)

(58) Field of Classification Search
CPC ..... G04B 37/14; G04B 37/1433; G04B 37/1446; G04B 37/1486; G04B 37/12; G04B 37/1413; A44C 5/14; A44C 5/147
See application file for complete search history.

(56) References Cited

U.S. PATENT DOCUMENTS 499,891 A 6/1893 Schlesicky
3,492,809 A * 2/1970 Gisiger-Lusa ..... A44C 5/14 368/282

(Continued)

FOREIGN PATENT DOCUMENTS

EP 0 198 801 10/1986
FR 2 678 812 1/1993

OTHER PUBLICATIONS

European Search Report dated Jan. 27, 2016 in European application 15165231.0, filed on Apr. 27, 2015(with English Translation).

*Primary Examiner* — Vit W Miska
(74) *Attorney, Agent, or Firm* — Oblon, McClelland, Maier & Neustadt, L.L.P.

(57) ABSTRACT

A watch intended to be removably mounted on a support, including a watch case and an independent removable attachment device arranged to retain the watch case in an opening provided in the support, the watch case including an upper portion, on the dial side, and a lower portion including a back cover, the lower portion being arranged to be housed inside the opening in the support and being of smaller dimensions than those of the upper portion to form a flat peripheral shoulder. The attachment device includes a flange having a central opening arranged to receive the lower portion of the watch case and an inner rim delimiting the central opening, the inner rim being arranged to be housed inside the opening in the support. The inner rim includes a locking device for locking the attachment device on the lower portion of the watch case.

14 Claims, 4 Drawing Sheets

(56) References Cited

U.S. PATENT DOCUMENTS

| | | | | |
|---|---|---|---|---|
| 4,645,102 | A | 2/1987 | Proellochs | |
| 4,769,799 | A | 9/1988 | Matsukage | |
| 5,610,877 | A * | 3/1997 | Adams | G04B 37/1433 368/10 |
| 2002/0096544 | A1 * | 7/2002 | Manigley | G04B 37/1486 224/164 |

* cited by examiner

WATCH INTENDED TO BE MOUNTED ON A REMOVABLE SUPPORT

This application claims priority from European Patent application 15165231.0 of Apr. 27, 2015, the entire disclosure of which is hereby incorporated herein by reference.

FIELD OF THE INVENTION

The present invention relates to a watch intended to be removably mounted on a support, comprising a watch case and an independent removable attachment device arranged to retain the watch case in an opening provided in the support, the watch case comprising an upper portion, on the dial side, and a lower portion comprising the back cover, said lower portion being arranged to be housed inside the opening in the support and being of smaller dimensions than those of the upper portion to form a flat peripheral shoulder.

BACKGROUND OF THE INVENTION

Such a watch is disclosed, for example, in FR patent 1557197. The attachment of the watch case to the strap or bracelet is achieved using a ring whose inner surface is adjusted to the diameter of the cylindrical side surface of a back-calotte forming the main element of the case. The ring is driven into the back-calotte. The drawback of driving in the ring is that it makes it difficult for the user to remove the ring to separate the strap or bracelet from the watch case, in particular for a user who is not strong. It is therefore difficult to change the strap. Further, if the ring is not properly adjusted, there is a risk that it will not remain fixed to the case and retain the strap. The assembly is then likely to come apart easily.

U.S. Pat. No. 4,742,503 and EP Patent 0379540 disclose devices for the removable assembly of a strap to a watch case by means of a bezel or a ring allowing the strap to be changed easily. However, in these devices, the bezel or ring appears visibly around the watch case, which impairs the aesthetic appearance of the watch.

EP Patent 0758767 discloses a device for the removable assembly of a strap to a watch case by means of a ring integral with the strap. Each of the bracelets owned by the user to change the appearance of his watch must therefore be fitted with a mounting ring, which increases the cost of the assembly. Further, the ring is mounted around the case on the dial side, so that it appears visibly around the watch dial, which impairs the aesthetic appearance of the watch.

SUMMARY OF THE INVENTION

It is an object of the invention to overcome the various drawbacks of known devices for the removable attachment of a strap to a watch case.

More specifically, it is an object of the invention to provide a device for the attachment of a watch on a support that allows the support or watch respectively to be simply and quickly changed, without any tools or force.

It is also an object of the invention to provide a device for attachment of a watch on a support that provides sufficient retention of the support on the watch case to prevent the watch case from falling off in the event of a shock, yet allows for easy disassembly of the support without any damage thereto.

It is also an object of the invention to provide a device for attachment of a watch to a support that does not alter the shape or appearance of the watch.

To this end, the present invention concerns a watch intended to be removably mounted on a support, comprising a watch case and an independent removable attachment device arranged to retain the watch case in an opening provided in the support, the watch case comprising an upper portion, on the dial side, and a lower portion comprising the back cover, said lower portion being arranged to be housed inside the opening in the support and being of smaller dimensions than those of the upper portion to form a flat peripheral shoulder.

According to the invention, the attachment device comprises a flange having a central opening arranged for receiving the lower case portion and an inner rim delimiting said central opening, said inner rim being arranged to be housed inside the opening in the support and having on its inner wall a locking device for locking the attachment device on the lower case portion, said locking device being arranged to allow the attachment device to be locked on the watch case in order to retain the support between the flange and the flat shoulder of the case and to allow the attachment device to be unlocked from the watch case by applying on the flange an outwardly directed force substantially perpendicular to the flange in order to release the support.

Thus, the device for attaching a watch to a support is invisible from the dial side of the watch and provides sufficient retention of the support on the watch case to prevent the watch case from falling off in the event of a shock, yet allows for easy disassembly of the support without any damage thereto.

Preferably, the locking device may comprise at least one rib arranged on the inner wall of the inner rim, said rib being arranged to cooperate with at least one correspondingly arranged groove on all or part of the periphery of the lower case portion.

Advantageously, the locking device may comprise at least two ribs arranged on the inner wall of the inner rim, symmetrically disposed with respect to a transverse axis of the attachment device and separated by a rib-free area. This improves the flexibility of the attachment device and facilitates the assembly/disassembly thereof.

Preferably, the inner rim may have at least one cutout portion along its free edge.

Advantageously, the inner rim may have at least two cutout portions along its free edge, symmetrically disposed with respect to a longitudinal axis of the attachment device, said cutout portions being arranged substantially in rib-free areas. At least one rib-free space may also be provided on the inner wall of the inner rim between a rib and a cutout portion. This further improves the flexibility of the attachment device and facilitates the assembly/disassembly thereof.

Advantageously, the flange may be extended by at least one outer rim projecting towards the case and arranged to form, with the flange, a housing for receiving the support. In order to further improve the flexibility of the attachment device and to facilitate the assembly/disassembly thereof, a cutout portion may be provided between the flange and the outer rim.

According to a preferred embodiment the support may be a bracelet or strap. In such case, the force applied on the flange to unlock the attachment device is applied by pulling the strap with an outwardly directed force substantially perpendicular to the flange, allowing the attachment device to be easily separated from the watch case.

BRIEF DESCRIPTION OF THE DRAWINGS

The objects, advantages and features of the present invention will appear more clearly in the following detailed description of an embodiment of the invention, given solely by way of non-limiting example and illustrated by the annexed drawings, in which.

DETAILED DESCRIPTION OF THE INVENTION

Figure 1:
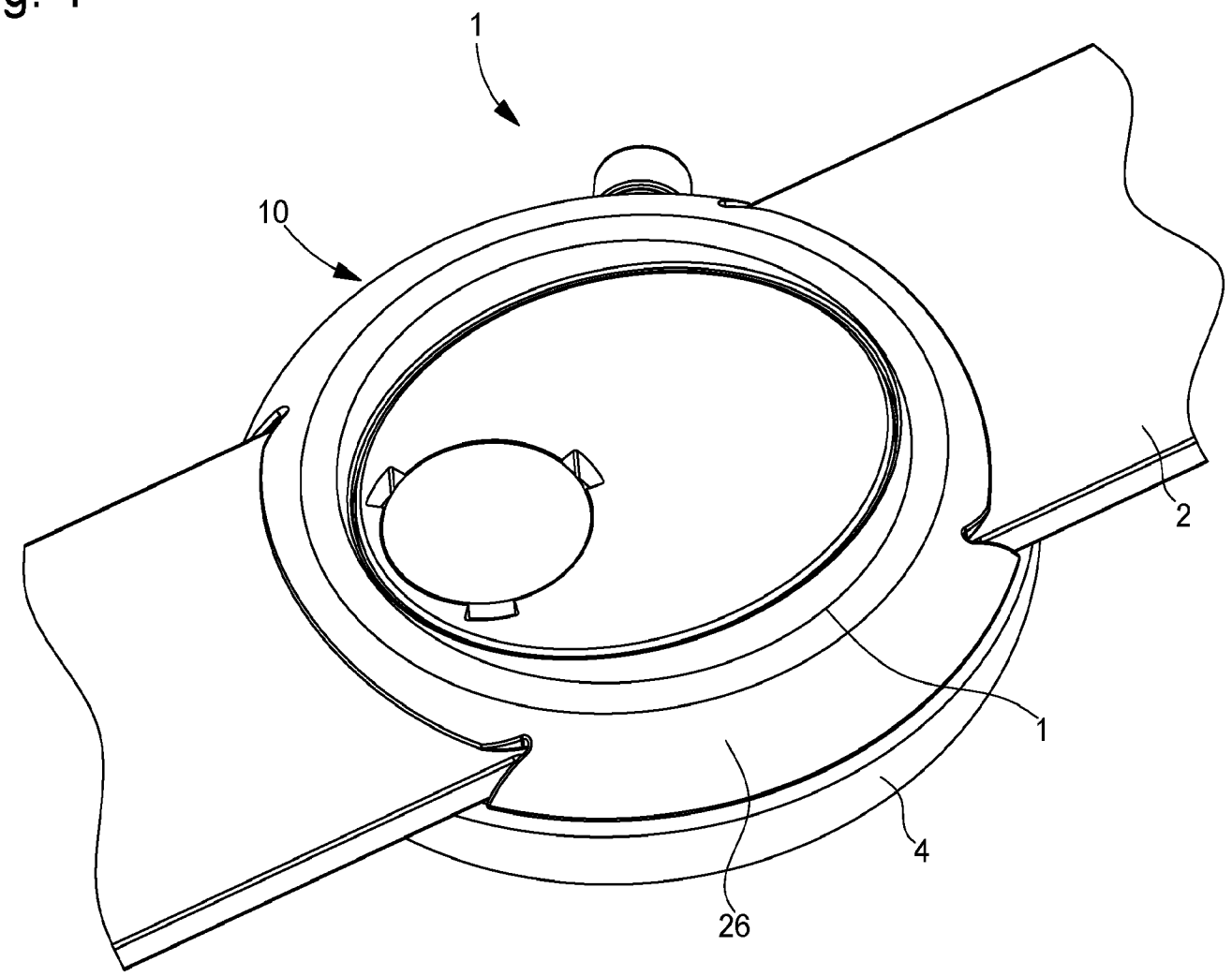
FIG. 1 is a perspective bottom view of a watch according to the invention.
Figure 2:
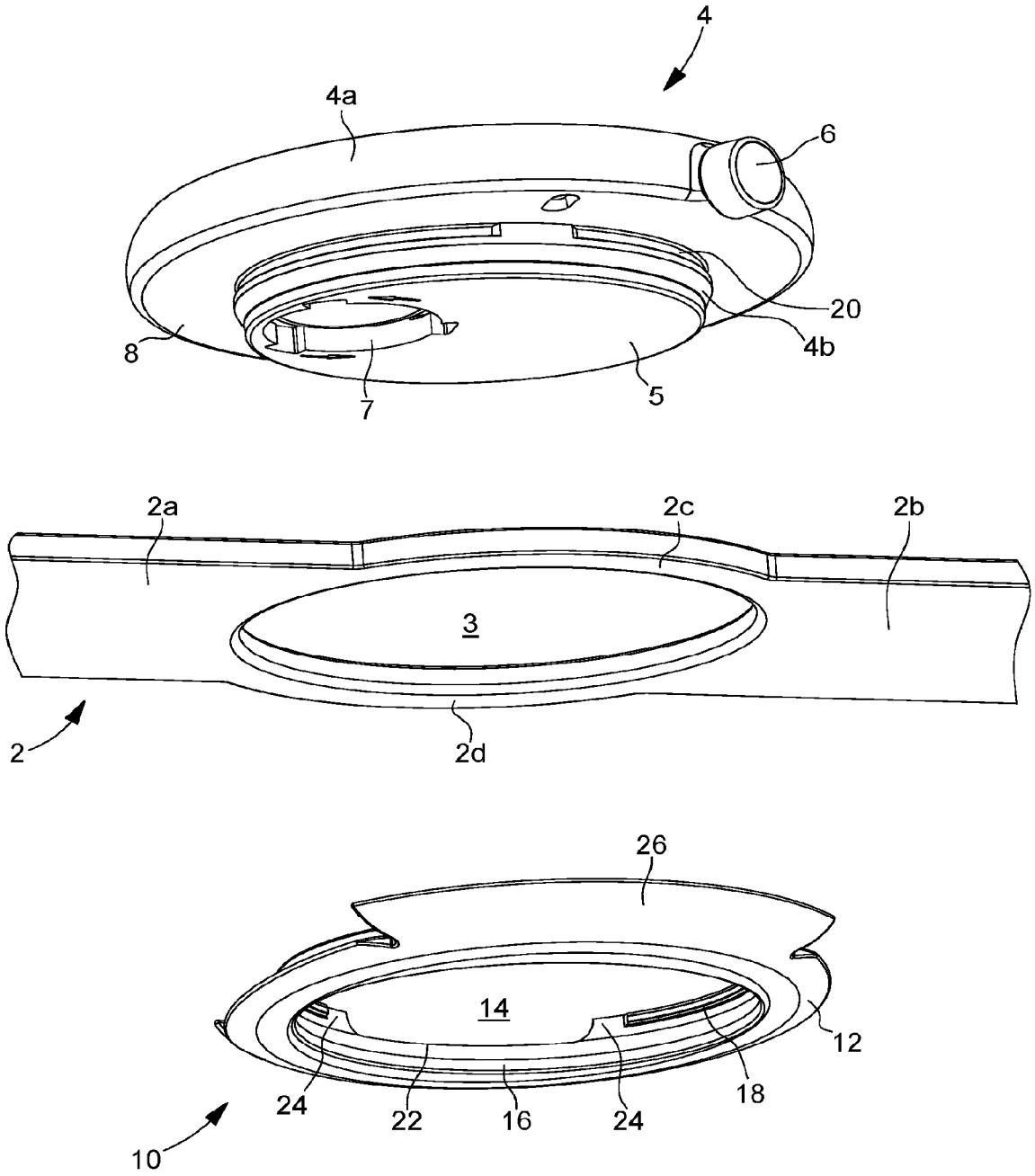
FIG. 2 is an exploded view of the watch of FIG. 1.

Referring to FIGS. 1 and 2, there is shown a watch 1, removably mounted on a bracelet or strap 2. As shown more clearly in FIG. 2, strap 2 has a central opening 3, of oval shape, defining two longitudinal areas 2*a*, 2*b* and two transverse areas 2*c*, 2*d*. The strap may be made of any material, such as for example leather, silicone, fabric, which may comprise internal reinforcement.

The watch comprises a watch case 4 comprising an upper portion 4*a*, located on the dial side, and a lower portion 4*b* comprising back cover 5 of case 4. Portion 4*a* contains, for example, a timepiece movement, with an orifice being provided for insertion of a winding stem ending in a crown 6. In the case of an electronic watch, lower portion 4*b* may have a housing 7 for accommodating a battery. Lower portion 4*b* has smaller dimensions than those of upper portion 4*a* to form a flat annular peripheral shoulder 8 whose role will be described below. The dimensions of upper portion 4*a* and lower portion 4*b* of case 4 are such that only lower portion 4*b* is housed inside opening 3 in strap 2. The thickness of lower portion 4*b* is greater than the thickness of strap 2.

Watch 1 also comprises an independent removable attachment device 10, arranged for the removable attachment of watch case 4 to strap 2.

Figure 5:
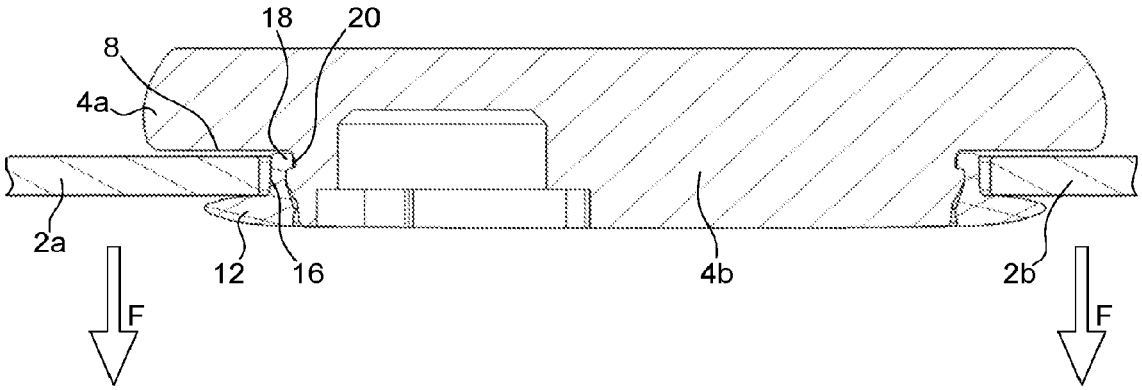
FIG. 5 is a longitudinal cross-sectional view of the watch of the invention.
Figure 6:
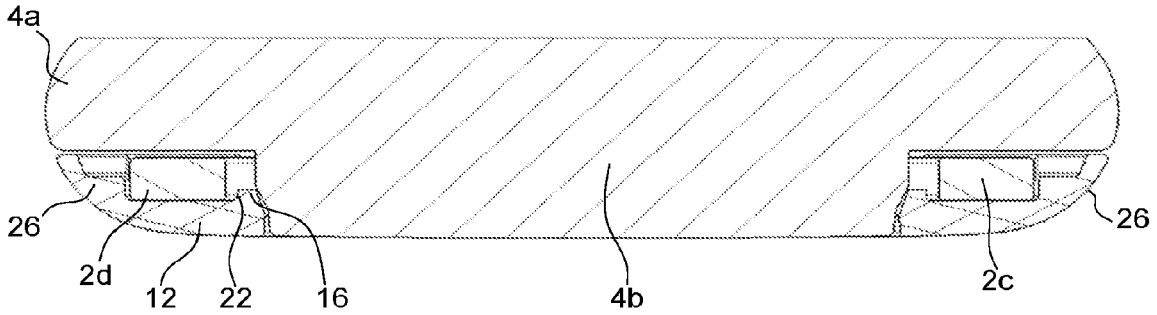
FIG. 6 is a transverse cross-sectional view of the watch of the invention.

According to the invention, attachment device 10 comprises a flange 12 having a central opening 14 and an inner rim 16, projecting substantially perpendicularly to flange 12 in the direction of case 4, and delimiting said central opening 14. As shown in FIGS. 5 and 6, the dimensions ("diameter") of central opening 14 and the height of flange 12 and of inner rim 16 are selected such that lower portion 4*b* of case 4 is housed inside said central opening 14. Moreover, the dimensions ("diameter") of flange 12 and of inner rim 14 are selected such that, on the one hand, inner rim 16 is housed inside opening 3 in the strap, and on the other hand, the inner face of flange 12 is in contact with strap 2 over a sufficient distance to ensure the retention of said strap 2 between the inner face of flange 12 and shoulder 8 in the space formed between flange 12 and shoulder 8.

Figure 3:
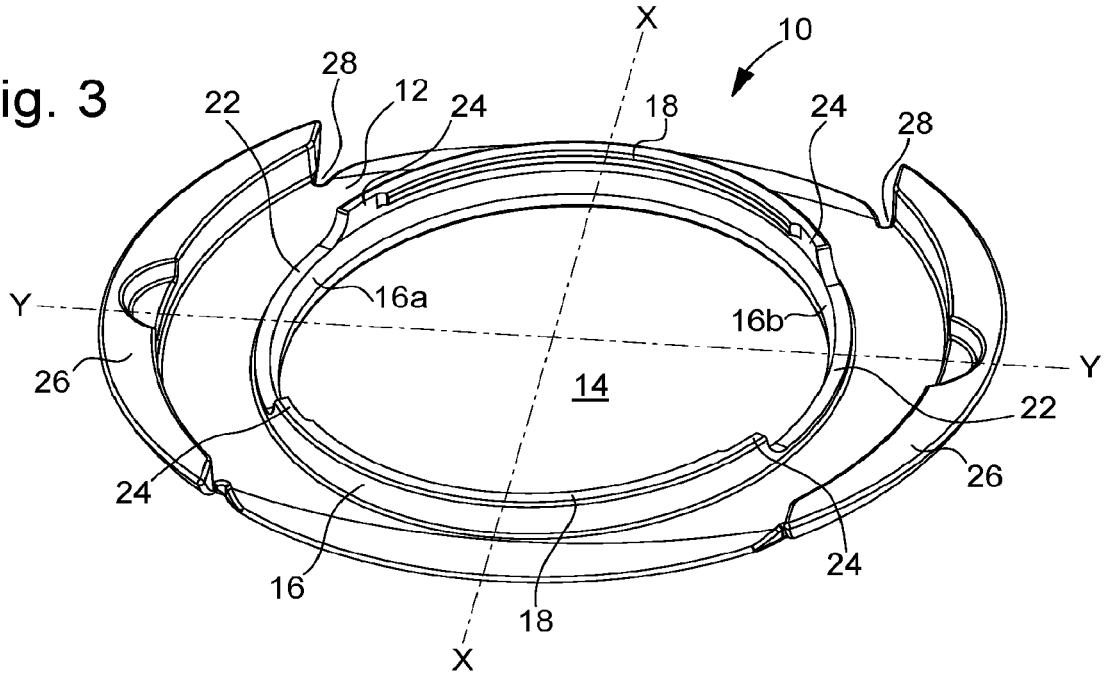
FIG. 3 is a perspective top view of the attachment device used in the present invention.
Figure 4:
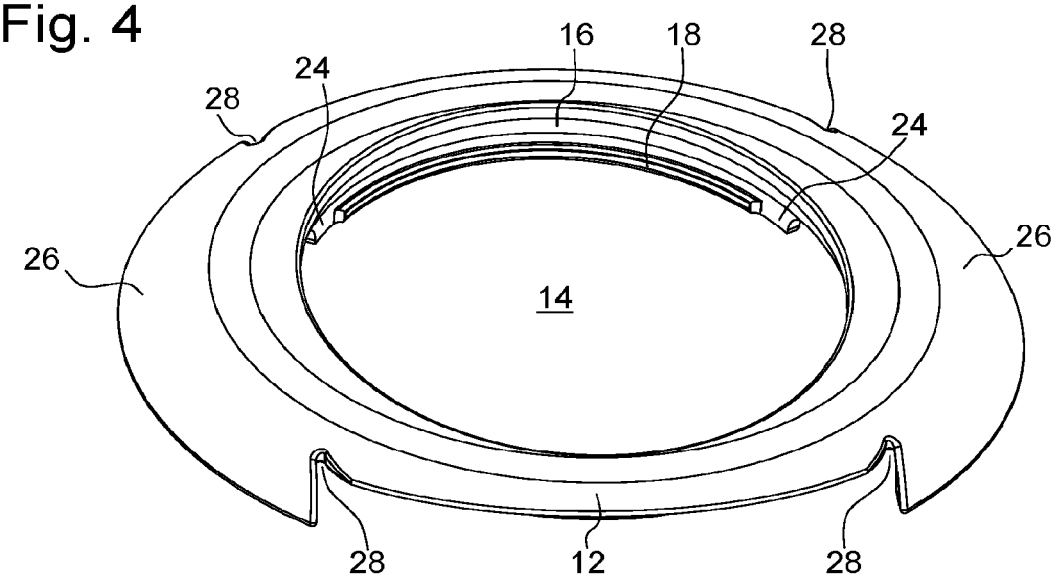
FIG. 4 is a perspective bottom view of the attachment device used in the present invention.

Further, the inner wall of inner rim 16, towards central opening 14, comprises a locking device for locking the attachment device on lower portion 4*b* of case 4. Referring more specifically to FIGS. 3 and 4, said locking device comprises two ribs 18 arranged on the inner wall of inner rim 16 and disposed symmetrically to each other with respect to a transverse axis Y of the attachment device. The two ribs 18 are separated by two rib-free areas 16*a*, 16*b* of inner rim 16 to ensure some flexibility. Ribs 18 are arranged to cooperate and engage in a groove 20 correspondingly arranged on the outer periphery of lower portion 4*b* of case 4. Two grooves may be provided or one continuous groove over substantially the entire periphery of lower portion 4*b*.

In order to improve the flexibility of attachment device 10, inner rim 16 has two cutout portions 22 along its free edge, arranged substantially in rib-free areas 16*a*, 16*b*. Cutout portions 22 reduce the height of inner rim 16. The two cutout portions are arranged symmetrically to each other with respect to a longitudinal axis X of attachment device 10. Further, rib-free spaces 24 are provided on the inner wall of inner rim 16 between a rib 18 and a cutout portion 22.

The dimensions of inner rim 16 and of ribs 18 are optimised to ensure the locking of attachment device 10 on case 4, while allowing ribs 18 to be easily released from groove 20 to separate attachment device 10 from case 4, simply by bending flange 12 along axis Y when the user applies on flange 12 an outwardly directed force substantially perpendicular to flange 12.

In the variant shown, flange 12 is extended by two outer rims 26 projecting in the direction of case 4, substantially perpendicularly to flange 12 and disposed symmetrically to each other with respect to longitudinal axis X of attachment device 10. The outer rims 26 are located substantially opposite cutout portions 22 and form, with the inner portion of flange 12 and case 4, a closed housing for accommodating transverse areas 2*c*, 2*d* of strap 2.

In order to improve the flexibility of attachment device 10, four cutout portions 28 are provided between flange 12 and the two outer rims 26.

Attachment device 10 is made of plastic material; any suitable plastic material may be used.

When the user wishes to assemble a strap 2 to watch case 4, he positions opening 3 of strap 2 level with lower portion 4*b* of case 4 and central opening 14 of attachment device 10. He locks attachment device 10 on case 4 by snapping ribs 18 into groove 20. As shown in FIGS. 5 and 6, the longitudinal areas 2*a*, 2*b* of strap 2 are retained in the space formed between shoulder 8 of case 4 and flange 12, and the transverse areas 2*c*, 2*d* of bracelet 2 are retained in the closed housing formed by case 4, flange 12 and outer rim 26. When the watch is worn, attachment device 10 is disposed underneath case 4 and the longitudinal areas of strap 2, so that it is not visible to the user and does not alter the external appearance of the watch. When the user wishes to change the strap, he applies an effortless force F (cf FIG. 5) on longitudinal areas 2*a*, 2*b* of strap 2, perpendicular to strap 2, so as to bend attachment device 10 around axis Y by pressing longitudinal areas 2*a*, 2*b* onto flange 12. Attachment device 10 bends around axis Y, ribs 18 move apart and are released from groove 20 thereby unlocking attachment device 10 from case 4. The user can then separate the attachment device from case 4 and remove strap 2. Attachment device 10 is autonomous and can be reused independently of strap 2.

In the present description, the support is a strap or bracelet but it is evident that the support could be any other suitable support.

What is claimed is:

1. A watch intended to be removably mounted on a support, comprising:

a watch case and an independent removable attachment device arranged to retain the watch case in an opening provided in the support, the watch case comprising an upper portion, on the dial side, and a lower portion comprising a back cover, said lower portion being arranged to be housed inside the opening in the support and being of smaller dimensions than those of the upper portion to form a flat peripheral shoulder, wherein the attachment device comprises a flange having a central opening arranged for receiving the lower portion of the watch case, at least one outer rim projecting from an outer perimeter of the flange in a direction of the watch case, and an inner rim delimiting said central opening, said inner rim being arranged to be housed inside the opening in the support, and wherein the inner rim comprises, on an inner wall thereof, a locking device for locking the attachment device on the lower portion of the watch case, arranged to allow the attachment device to be locked on the watch case in order to retain the support between the flange and the flat shoulder of the watch case and to allow the attachment device to be unlocked from the watch case by applying on the flange an outwardly directed force substantially perpendicular to the flange in order to release the support.

2. The watch according to claim 1, wherein the locking device comprises at least one rib arranged on the inner wall of the inner rim, said rib being arranged to cooperate with at least one correspondingly arranged groove on all or part of the periphery of the lower portion of the watch case.

3. The watch according to claim 2, wherein the locking device comprises at least two ribs arranged on the inner wall of the inner rim, symmetrically disposed with respect to a transverse axis of the attachment device and separated by a rib-free area.

4. The watch according to claim 1, wherein the inner rim has at least one cutout portion along the free edge thereof.

5. The watch according to claim 3, wherein the inner rim has at least two cutout portions along the free edge thereof, symmetrically disposed with respect to a longitudinal axis of the attachment device, said cutout portions being arranged substantially in the rib-free areas.

6. The watch according to claim 5, wherein at least one rib-free space is provided on the inner wall of the inner rim between a rib and a cutout portion.

7. The watch according to claim 1, wherein the at least one outer rim is arranged to form, with the flange, a housing for receiving the support.

8. The watch according to claim 7, wherein a cutout portion is provided between the flange and the outer rim.

9. The watch according to claim 1, wherein the support is a strap or bracelet.

10. The watch according to claim 9, wherein the force applied on the flange to unlock the attachment device is applied by pulling the strap with an outwardly directed force substantially perpendicular to the flange.

11. The watch according to claim 1, wherein the at least one outer rim is two outer rims disposed symmetrically with respect to a longitudinal axis of the attachment device.

12. The watch according to claim 11, wherein the inner rim has two cutout portions along the free edge thereof, symmetrically disposed with respect to the longitudinal axis of the attachment device.

13. The watch according to claim 12, wherein the two outer rims are located opposite to the two cutout portions of the inner rim.

14. The watch according to claim 1, wherein the at least one outer rim is perpendicular to the flange.

* * * * *